United States Patent [19]

Sasaki et al.

[11] Patent Number: 4,609,618

[45] Date of Patent: Sep. 2, 1986

[54] SILVER HALIDE PHOTOGRAPHIC LIGHT-SENSITIVE MATERIAL

[75] Inventors: Masao Sasaki; Kaoru Onodera, both of Odawara, Japan

[73] Assignee: Konishiroku Photo Industry Co., Ltd., Tokyo, Japan

[21] Appl. No.: 805,251

[22] Filed: Dec. 4, 1985

Related U.S. Application Data

[63] Continuation of Ser. No. 558,785, Dec. 16, 1983, abandoned.

[30] Foreign Application Priority Data

Dec. 9, 1982 [JP] Japan ..... 57-216176

[51] Int. Cl.[4] ..... G03C 7/26; G03C 7/34

[52] U.S. Cl. ..... 430/546; 430/552; 430/553

[58] Field of Search ..... 430/552, 553, 546

[56] References Cited

U.S. PATENT DOCUMENTS

| | | | |
|---|---|---|---|
| 2,322,027 | 6/1943 | Jelley et al. | 430/546 |
| 4,124,396 | 11/1978 | Osborn | 430/553 |
| 4,362,810 | 12/1982 | Usagawa et al. | 430/553 |
| 4,407,940 | 10/1983 | Nakamura et al. | 430/546 |
| 4,451,558 | 5/1984 | Sugita et al. | 430/553 |
| 4,455,367 | 6/1984 | Seoka et al. | 430/546 |

*Primary Examiner*—Mary F. Downey

*Attorney, Agent, or Firm*—Jordan B. Bierman

[57] ABSTRACT

Silver halide photographic light-sensitive material comprising a support and at least one silver halide emulsion layer thereon, said layer comprising at least one cyan coupler of Formula I, said coupler having been dispersed in said emulsion layer by use of at least one solvent of Formula II, t,0020 wherein $R_1$ is an alkyl radical or an aryl radical; $R_2$, $R_3$, $R_4$, $R_5$ and $R_6$ each is a radical selected from the group consisting of hydrogen, halogens, hydroxyl radical, nitro radical, cyano radical, alkyl radicals, alkoxy radicals, aryl radicals, aryloxy radicals, alkylsulfamoyl radicals, arylsulfamoyl radicals, alkyloxycarbonyl radicals, aryloxycarbonyl radicals, alkylsulfonamido radicals, arylsulfonamido radicals, alkylsulfonyl radicals and arylsulfonyl radicals, provided that when $R_2$ is a radical selected from said alkylsulfonamido radicals, $R_6$ also is selected from said alkylsulfonamido radicals; and $Z_1$ is a hydrogen atom, a halogen atom, or a radical that can be split off by the reaction of said coupler with the oxidized product of an aromatic primary amine-type color developing agent,

II wherein $R_7$ and $R_8$ each is an alkyl radical, an alkenyl radical or an aryl radical, provided that the sum of the carbon atoms of the radicals represented by $R_7$ and $R_8$ is from 16 to 36.

20 Claims, No Drawings

SILVER HALIDE PHOTOGRAPHIC LIGHT-SENSITIVE MATERIAL

This application is a continuation, of application Ser. No. 558,785, filed 12-16-83 now abandoned.

This Application claims priority of Japanese Application 216176/1982, filed Dec. 9, 1982.

BACKGROUND OF THE INVENTION

1. Field of the Invention

The present invention relates to a silver halide photographic light-sensitive material, and more particularly to a silver halide photographic light-sensitive material containing a cyan coupler which is excellent in the dispersion stability and capable of forming well-preservable dye images.

2. Description of the Prior Art

The formation of a dye image by use of a silver halide color photographic light-sensitive material is usually carried out by the process that an aromatic primary amine-type color developing agent itself, when reducing the silver halide particles of the exposed silver halide color photographic light-sensitive material, is oxidized to produce an oxidized product, and the product then reacts with a coupler that is in advance contained in the silver halide color photographic light-sensitive material to thereby form a dye image. And, as the coupler, because color reproductions are usually effected by the subtractive color process, yellow, magenta and cyan color dyes-forming three different couplers are used.

These couplers each is usually dissolved into a substantially water-insoluble high-boiling organic solvent, if necesarry, in combination with an auxiliary solvent, and the resulting solution is then added to a silver halide emulsion.

Fundamental requirements for the nature of these couplers are such that the coupler shall have a large solubility in high-boiling organic solvents; shall have so satisfactory dispersibility and dispersion stability in a silver halide emulsion layer that it is hardly crystallized in the emulsion; shall be capable of giving satisfactory photographic characteristics; and the dye image formed from the coupler shall be highly resistant to light, heat and moisture, —especially, in the cyan coupler, the improvement on the heat resistance (dark discoloration characteristic; same meaning of dark fading properties) thereof has recently become an important question.

Those conventionally known cyan couplers include 2,5-di-acylaminophenol-type couplers which are phenol compounds substituted in the second and fifth positions thereof by acylamino radicals, as described in, e.g., U.S. Pat. No.2,895,826 and Japanese Patent Publication Open to Public Inspection (hereinafter referred to as Japanese Patent O.P.I. Publication) Nos. 112038/1975, 109630/1978 and 163537/1980.

These 2,5-diacylaminophenol-type cyan couplers are often used because they form cyan dye images satisfactory in respect of the dark-discoloration characteristic, but have the disadvantage that the dye image is very inferior in the light-discoloration characteristic.

Upon this, as means to improve the light-discoloration characteristic (same meaning of light-fading properties) of the 2,5-diacylaminophenol-type cyan coupler, the combined use therewith of benzotriazole compounds is proposed as described in, e.g., Japanese Patent O.P.I. Publication No. 151149/1975. However, such compounds are considered impractical due to the fact that they have a high tendency to crystallize and have a limited effect on the light-discoloration characteristic to ultraviolet rays alone. Further as the means there are also known the use of such conventionally used high-boiling solvents as dibutyl phthalate in an increased quantity, but the use of it in an increased quantity, although it improves the light-discoloration characteristic slightly, has an adverse effect upon the photographic characteristic such as the color tone as well as upon the dark-discoloration characteristic.

Japanese Patent O.P.I. Publication No. 173835/1982 proposes a method for improving the color tone and the fastness of the dye formed from 2,5-diacylaminophenol cyan coupler which is the phenol compound substituted in the second position thereof by orthosulfonamidophenylacylamino radical by way of dispersing the coupler into a high-boiling organic solvent having a specific dielectric constant. However, this method considerably impairs the light-discoloration characteristic of the cyan dye image.

SUMMARY OF THE INVENTION

Objects of the Invention

It is therefore a first object of the present invention to provide a silver halide photographic light-sensitive materail which is capable of forming a dye image that is improved on the balance of resistances to light, heat and moisture, thus having an excellent image preservability even under high temperature and humidity conditions.

It is a second object of the present invention to provide a silver halide photographic light-sensitive material which is capable of forming a sturdy dye image having an improved light-discoloration characteristic without deteriorating the dark-discoloration characteristic thereof.

It is a third object of the present invention to provide a silver halide photographic light-sensitive material which is capable of forming a dye image improved on the image preservability without having any adverse effect upon the photographic characteristics.

It is a fourth object of the present invention to provide a silver halide photographic light-sensitive material which contains a cyan coupler that is dispersed thereinto by use of a very stably dispersible high-boiling organic solvent, and which therefore is excellent in the cyan coupler dispersion stability and is free from any coupler crystallization trouble.

DETAILED DESCRIPTION OF THE INVENTION

It has now been found that the above objects can be accomplished by a silver halide photographic light-sensitive material comprising a support having thereon at least one silver halide emulsion layer, the at least one silver halide emulsion layer containing at least one of those cyan couplers having the following Formula [I], dispersed thereinto by use of at least one of those high-boiling organic solvents having the following Formula [II], and thus the present invention has been completed.

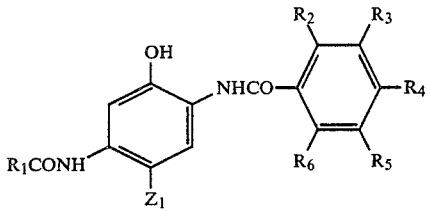

Formula [I]

wherein $R_1$ is an alkyl radical or an aryl radical; $R_2$, $R_3$, $R_4$, $R_5$ and $R_6$ each is a radical selected from the group consisting of hydrogen, halogens, hydroxyl radical, nitro radical, cyano radical, alkyl radicals, alkoxy radicals, aryl radicals, aryloxy radicals, alkylsulfamoyl radicals, arylsulfamoyl radicals, alkyloxycarbonyl radicals, aryloxycarbonyl radicals, alkylfulfonamido radicals, arylsulfonamido radicals, alkylsulfonyl radicals and arylsulfonyl radicals, provided that if $R_2$ is a radical selected from the alkylsulfonamido radicals, $R_6$ also is a radical selected from the same alkylsulfonamido radicals; and $Z_1$ is a hydrogen atom, a halogen atom or a radical that can be split off by the reaction of the coupler with the oxidized product of an aromatic primary amine-type color developing agent.

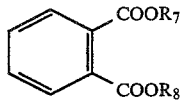

Formula [II]

wherein $R_7$ and $R_8$ each is an alkyl radical, an alkenyl radical or an aryl radical, provided that the total number of the carbon atoms of these radicals represented by $R_7$ and $R_8$ is from 16 to 36.

In the present invention, those alkyl radicals represented by the $R_1$ of Formula [I] are of the straight chain or branched chain, and include, e.g., methyl, ethyl, propyl, butyl, pentyl, hexyl, peptyl, octyl, nonyl, decyl, undecyl, dodecyl, tridecyl, tetradecyl, pentadecyl, hexadecyl, heptadecyl, octadecyl, and the like radicals. These alkyl radicals are allowed to have a single substituent or a plurality of substituents. The typical substituents include phenoxy radicals [the phenoxy radical also being allowed to have such a substituent as typified by a halogen atom (e.g., chlorine, fluorine), hydroxyl, nitro, cyano, an alkyl (e.g., methyl, ethyl, dodecyl), an alkoxy (e.g., methoxy, ethoxy), an aryl (e.g., phenyl, tolyl), an aryloxy (e.g., phenoxy, naphthoxy), an alkylsulfonyl (e.g., butylsulfamoyl), an arylsulfamoyl (e.g., phenylsulfamoyl), an alkyloxycarbonyl (e.g., n-octyloxycarbonyl), aryloxycarbonyl (e.g., phenoxycarbonyl), or the like], alkylacylamino radicals (e.g., acetylamino), arylacylamino radicals (e.g., benzoylamino), alkylthio radicals (e.g., methylthio), arylthio radicals (e.g., phenylthio), alkylsulfonyl radicals (e.g., methylsulfonyl), arylsulfonyl radicals (e.g., phenylsulfonyl), alkoxy radicals (e.g., methoxy), alkyloxycarbonyl radicals (e.g., methoxycarbonyl), and aryloxycarbonyl radicals (e.g., phenoxycarbonyl). Not less than two of these substituents are allowed to be introduced to the alkyl. Those aryl radicals represented by the $R_1$ include, e.g., phenyl, naphthyl, and the like radicals, which are allowed to have substitutents typical ones of which include halogens (e.g., chlorine, fluorine), hydroxyl radical, nitro radical, cyano radical, alkyl radicals (e.g., methyl, ethyl, dodecyl), alkylsulfonyl radicals (e.g., dodecylsulfonyl), aryloxy radicals (e.g., phenoxy), alkylsulfamoyl radicals (e.g., butylsulfamoyl), arylsulfamoyl radicals (e.g., phenylsulfamoyl), alkyloxycarbonyl radicals (e.g., n-octyloxycarbonyl), aryloxycarbonyl radicals (e.g., phenoxycarbonyl), and the like.

The preferred radicals represented by the $R_1$ are alkyl radicals having phenoxy radical as a substituent (such as, e.g., 2,4-di-t-butylphenoxypentyl radical, 2,4-di-t-pentylphenoxypropyl radical, 2,4-di-t-butylphenoxybutyl radical, 2,4-di-t-pentylphenoxypentyl radical); alkyl radicals having an arylsulfonyl radical as a substituent such as, e.g., 2,4-di-t-butylphenylsulfonyl; alkyl radicals having an arylthio radical as a substituent such as, e.g., 2,4-di-t-butylphenylthio; phenyl radicals having an alkyl radical as a substituent (such as, e.g., 2,4-di-t-butylphenyl radical, 2,4-di-t-pentylphenyl); and the like.

In the present invention, the preferred radicals as the $R_1$ are those having the following Formula [III]:

Formula [III]

$$R_9—X—R_{10}—$$

In Formula [III], $R_9$ is an alkyl radical (such as, e.g., n-butyl, n-pentyl, n-octyl, n-nonyl, n-decyl, n-undecyl, n-dodecyl, n-tridecyl, n-tetradecyl, n-hexadecyl, n-octadecyl, sec-pentadecyl, sec-tridecyl, t-octyl, t-nonyl, or the like) or a phenyl radical. The phenyl radical is allowed to have a single substituent or a plurality of substituents whose typical examples include halogen atoms (e.g., fluorine, chlorine, bromine), hydroxyl radical, cyano radical, nitro radical, alkyl radicals (e.g., methyl, ethyl, butyl, pentyl, octyl, dodecyl, etc.), alkoxy radicals (e.g., methoxy, ethoxy, butoxy, octoxy, etc.), alkylsulfamoyl radicals (e.g., butylsulfamoyl, octylsulfamoyl, etc.), arylsulfamoyl radicals (e.g., phenylsulfamoyl, xylylsulfamoyl, tolylsulfamoyl, mesitylsulfamoyl, etc.), alkyloxycarbonyl radicals (e.g., methyloxycarbonyl, butyloxycarbonyl, etc.) and aryloxycarbonyl radicals (e.g., phenyloxycarbonyl, xylyloxycarbonyl, tolyloxycarbonyl, etc.) and the like. Not less than two of these substituents may be introduced to the phenyl. The preferred radical represented by the $R_9$ is phenyl radical, particularly the phenyl radical having as a substituent hydroxyl, an alkyl or alkyloxycarbonyl radical, and more particularly the phenyl radical having in the second and fourth positions thereof alkyl radicals in the branched-chain form.

$R_{10}$ represents an alkylene radical, preferably an alkylene radical having from 1 to 20 carbon atoms in the straight-chain or branched-chain form, and more preferably an alkylene radical having from 2 to 14 carbon atoms (such as, e.g., $\alpha$-butylmethylene, $\alpha$-ethylmethylene, $\alpha$-dodecylmethylene, or the like radicals).

X represents a divalent radical such as —O—, —S—, —SO—, or —$SO_2$—.

In Formula [I], $R_2$, $R_3$, $R_4$, $R_5$ and $R_6$ each is a radical selected from the group consisting of hydrogen, halogens (e.g., fluorine, chlorine, bromine, etc.), hydroxyl radical, nitro radical, cyano radical, alkyl radicals (e.g., methyl, ethyl, propyl, octyl, decyl, dodecyl, etc.), alkoxy radicals (e.g., methoxy, ethoxy, octoxy, etc.), aryl radicals (e.g., phenyl), aryloxy radical (e.g., phenoxy), alkylsulfamoyl radicals (e. g., butylsulfamoyl, octylsulfamoyl, N,N-dimethylsulfamoyl, etc.), arylsulfamoyl radicals (e.g., phenylsulfamoyl, xylylsulfamoyl, tolylsulfamoyl, mesitylsulfamoyl, etc.), alkyloxycarbonyl radicals (e.g., methyloxycarbonyl, butyloxycarbonyl, octyloxycarbonyl, etc.), aryloxycarbonyl radicals (e.g., phenyloxycarbonyl, xylyloxycarbonyl, tolyloxycarbonyl, mesityloxycarbonyl, etc.), alkylsulfonamido radicals (e.g., methyloxysulfonamido, butylsulfonamido, octylsulfonamido, etc.), arylsulfonamido radicals (e.g., phenylsulfonamido, 2,4-di-t-butylphenylsulfonamido, etc.), alkylsulfonyl radicals (e.g., butylsulfonyl, etc.), and arylsulfonyl radicals (e.g., phenylsulfonyl, etc.). Of the preferred radicals represented by $R_2$, $R_3$, $R_4$, $R_5$ and $R_6$, those preferred represented by the $R_2$ and $R_6$ are hydrogen, halogens, alkyl radicals and alkoxy radicals; and those preferred as the $R_3$, $R_4$ and $R_5$ are hydrogen, halogens, alkyl radicals, alkylsulfonamido radicals, cyano radical, hydroxyl radical, alkyloxycarbonyl radicals and alkylsulfonyl radicals.

Those radicals represented by $Z_1$ that can be split off by the reaction with the oxidized product of an aromatic primary amine-type color developing agent are known to those skilled in the art, and act advantageously in the coupler-containing layers and other layers of a silver halide photographic light-sensitive material by changing the reactivity of the coupler or by splitting from the coupler to thereby fulfill development inhibiting, bleach inhibiting and color compensating functions in the layers. Typical radicals as the $Z_1$ are, for example, halogens (e.g., fluorine, chlorine, bromine), alkoxy radicals (e.g., methoxy, ethoxy, octoxy), aryloxy radicals (e.g., phenyloxy, etc.), cyclohexyloxy radicals, arylazo radicals (e.g., phenylazo, etc.), thioether (e.g., benzylthio, etc.), heterocyclic radicals (e.g., oxazolyl, diazolyl, triazolyl, tetrazolyl, etc.), aralkylcarbonyloxy radicals, and the like. The most preferred examples as the $Z_1$ are hydrogen and halogens (preferably chlorine).

The following are typical examples of those cyan couplers having Formula [I], but the present invention is not limited thereto.

(I-1)

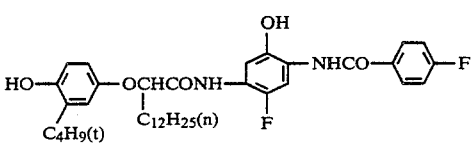

(I-2)

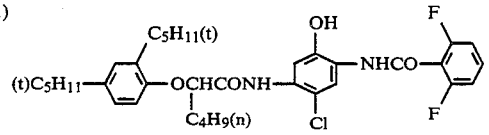

(I-3)

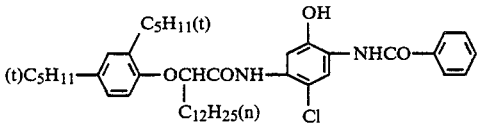

(I-4)

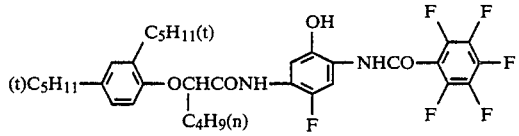

(I-5)

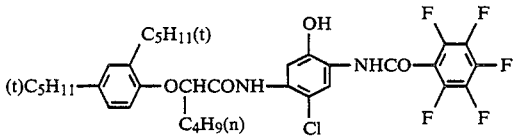

(I-6)

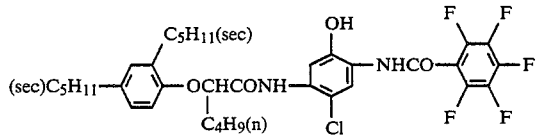

(I-7)

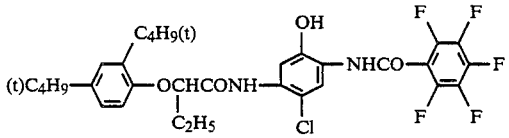

(I-8)

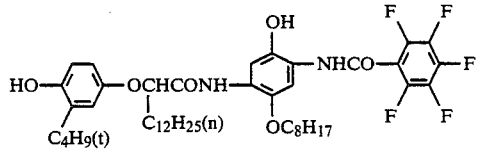

(I-9)

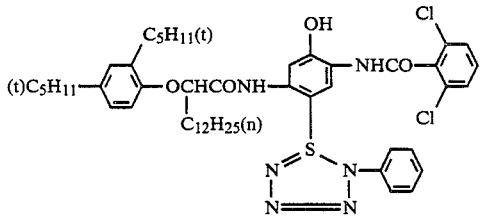

(I-10)

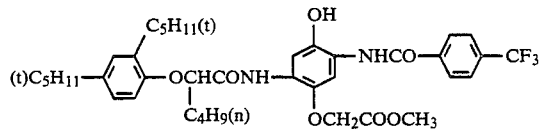

(I-11)

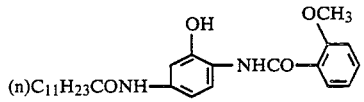

(I-12)

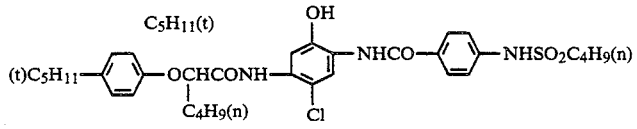

-continued
(I-13)
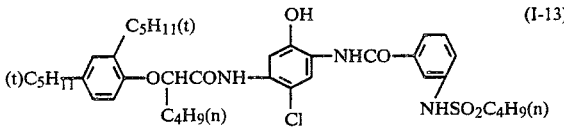
(I-14)
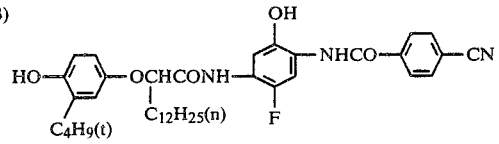
(I-15)
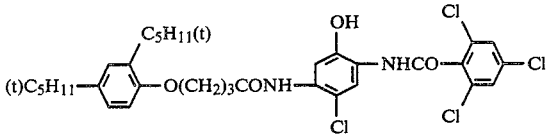
(I-16)
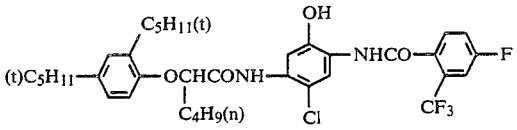
(I-17)
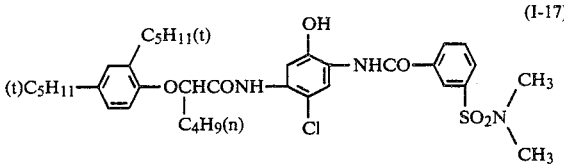
(I-18)
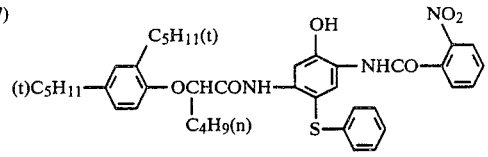
(I-19)
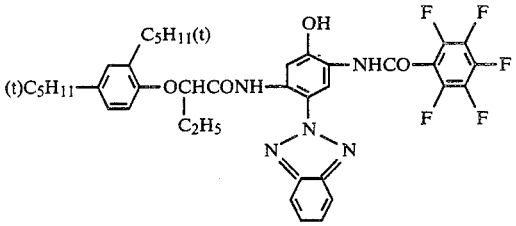
(I-20)
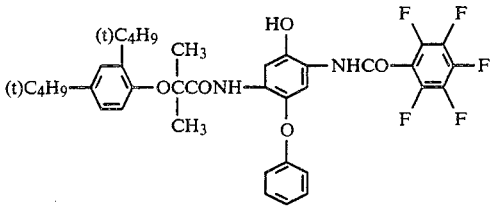
(I-21)
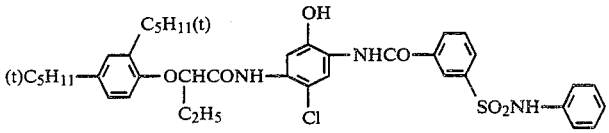
(I-22)
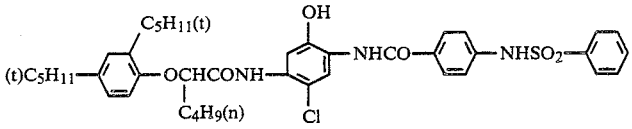
(I-23)
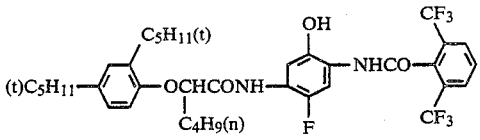
(I-24)
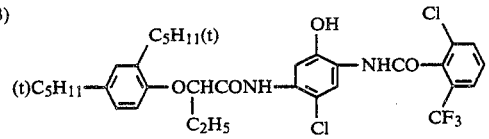
(I-25)
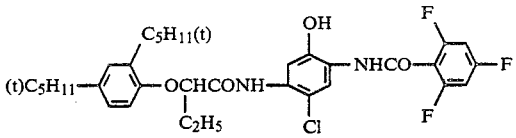
(I-26)
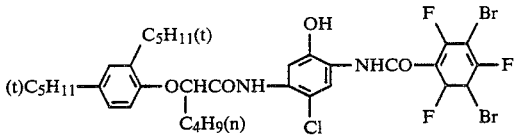
(I-27)
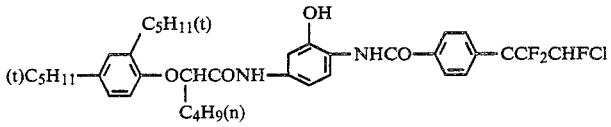
(I-28)
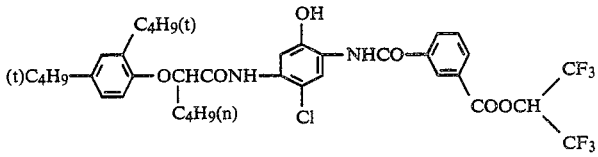

-continued (I-29)

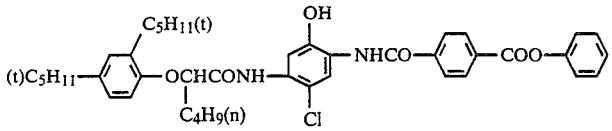

(I-30)

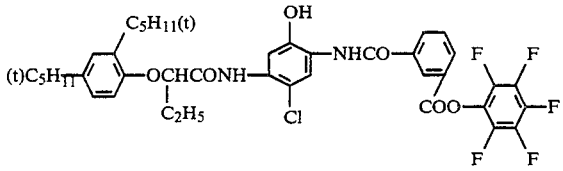

(I-31)

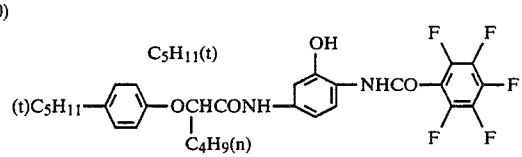

(I-32)

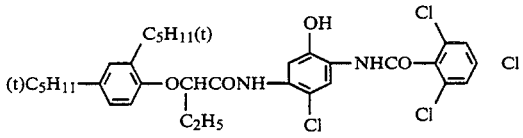

(I-33)

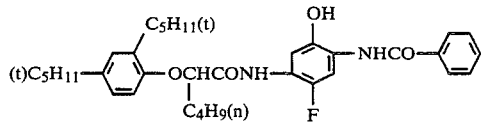

(I-34)

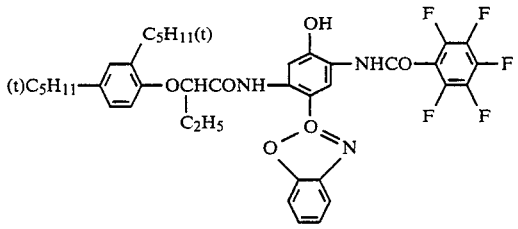

(I-35)

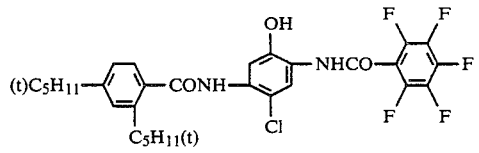

(I-36)

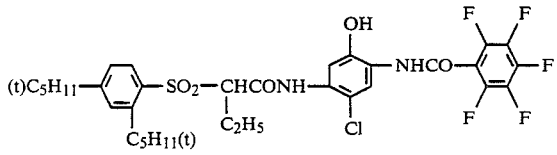

(I-37)

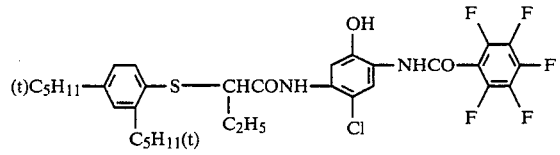

In the present invention, any of the cyan couplers having Formula [I] may be used in combination with any of conventionally known couplers within the range not deviating from the objects of the present invention. When incorporating the coupler of the present invention having Formula [I] into a silver halide emulsion layer, the coupler is used usually in a quantity of from about 0.05 mole to about 2 moles, and preferably from 0.1 mole to 1 mole per mole of silver halide.

The reason why the total number of the carbon atoms of the radicals represented by the $R_7$ and $R_8$ of Formula [II] should be from 16 to 36 in the present invention is because if it is less than 16, the objective improvement effect of the present invention would not be carried out, while if it exceeds 36, the function of the solvent as the coupler solvent would become reduced to allow the undesirable deposition of the coupler. Those alkyl radicals represented by the $R_7$ or $R_8$ include, for example, methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, and the like radicals; those aryl radicals are phenyl, naphthyl, and the like radicals; and those alkenyl radicals include butenyl, pentenyl, hexenyl, heptenyl, octadecenyl, and the like radicals. These alkyl, alkenyl and aryl radicals are allowed to have a single substituent or a plurality of substituents. Those substituents introducible to the alkyl and alkenyl include, for example, halogens (e.g., chlorine, fluorine), alkoxy radicals (e.g., methoxy), aryl radicals (e.g., phenyl), aryloxy radicals (e.g., phenoxy), alkenyl radicals (e.g., butenyl), alkoxycarbonyl radicals (e.g., methoxycarbonyl), and the like; and those substituents introducible to the aryl include, for example, halogens (e.g., chlorine, fluorine), alkyl radicals (e.g., methyl, ethyl), alkoxy radicals (e.g., methoxy), aryl radicals (e.g., phenyl), aryloxy radicals (e.g., phenoxy), alkenyl radicals (e.g., butenyl), alkoxycarbonyl radicals (e.g., methoxycarbonyl), and the like. Not less than two of these substituents may be introduced to the alkyl, alkenyl or aryl radical.

The high-boiling organic solvent usable in the present invention has generally a boiling point of not less than 175° C. under the one atmospheric pressure condition.

The high-boiling organic solvent having Formula [II] in the present invention may be used in any quantity according to the kind and quantity of the cyan coupler used, but preferably in a quantity of from 0.1 to $10^3$ parts by weight, and more preferably from 10 to 200 parts by weight per 100 parts by weight of the cyan coupler of the present invention. The high-boiling organic solvent having Formula [II] in the present invention may be used together with any other conventionally known high-boiling organic solvent within the range not deviating from the objects of the present invention. The known high-boiling organic solvent includes phthalates such as dibutyl phthalate, dimethyl phthalate, dibenzyl phthalate, etc.; phosphates such as tricresyl phosphate, trihexyl phthalate, etc.; N,N-diethyl-laurylamide, 3-pentadecylphenylethyl-ether, 2,5-di-sec-amylphenylbutyl-ether, 2-ethyl-hexanol, and the like.

The following are typical examples of the high-boiling organic solvent having Formula [II], but the present invention is not limited thereto.

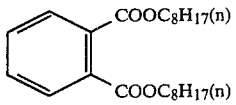
(II-1)

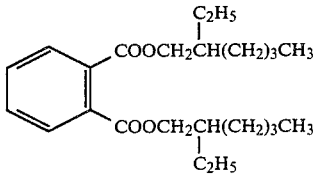
(II-2)

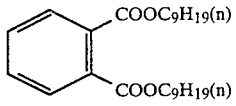
(II-3)

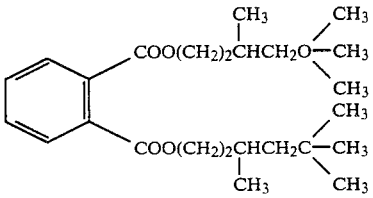
(II-4)

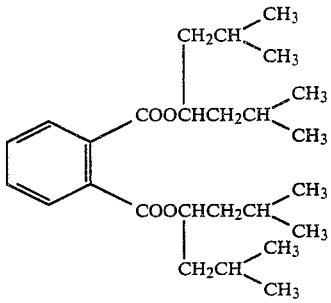
(II-5)

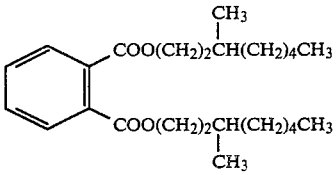
(II-6)

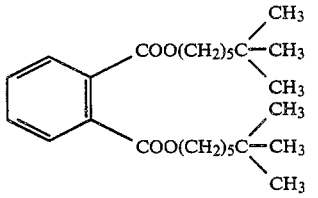
(II-7)

-continued

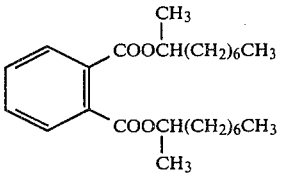
(II-8)

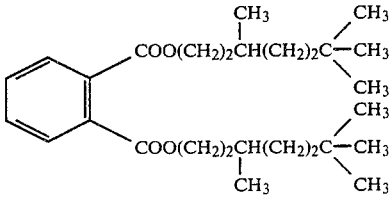
(II-9)

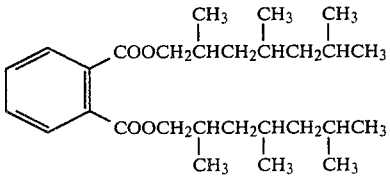
(II-10)

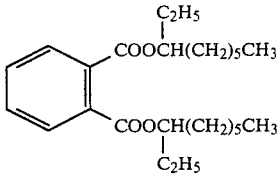
(II-11)

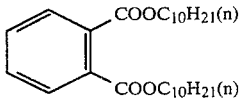
(II-12)

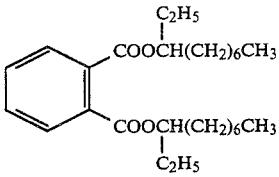
(II-13)

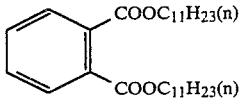
(II-14)

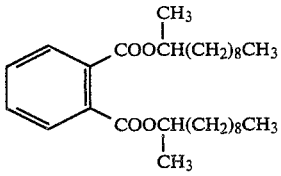
(II-15)

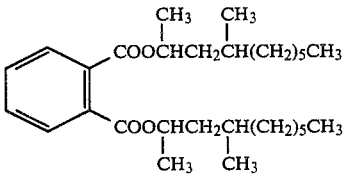
(II-16)

-continued
(II-17)
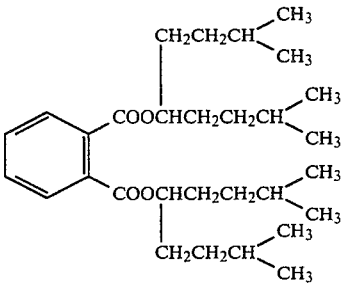
(II-18)
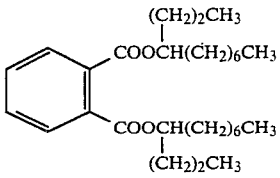
(II-19)
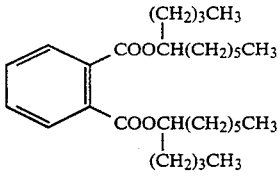
(II-20)
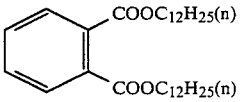
(II-21)
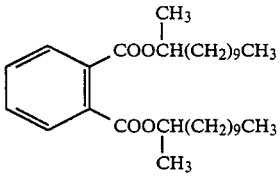
(II-22)
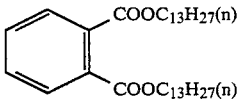
(II-23)
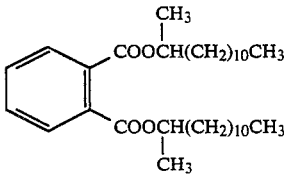
(II-24)
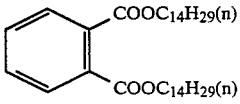
-continued
(II-25)
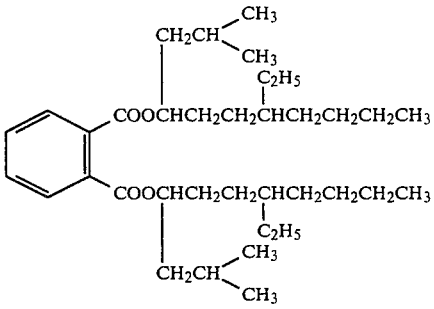
(II-26)
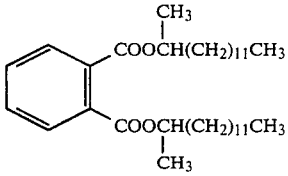
(II-27)
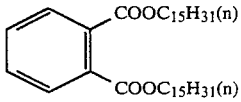
(II-28)
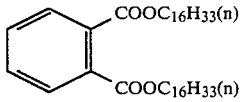
(II-29)
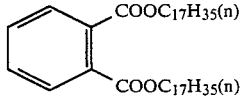
(II-30)
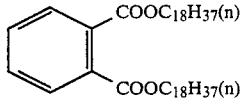
(II-31)
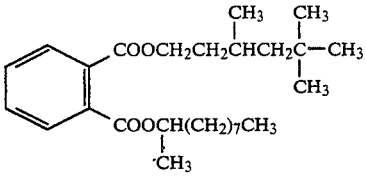
(II-32)
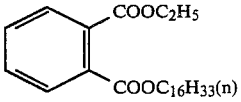
(II-33)
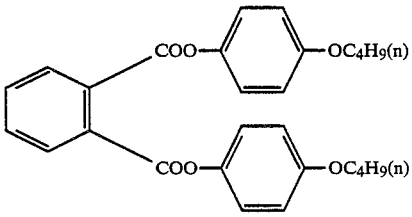
(II-34)
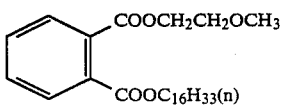

-continued (II-35)

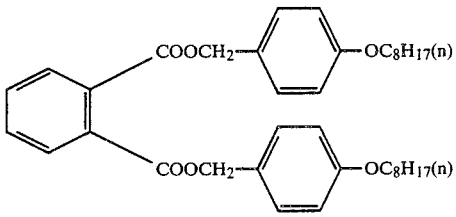

(II-36)

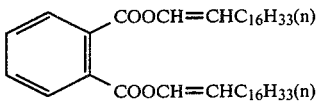

(II-37)

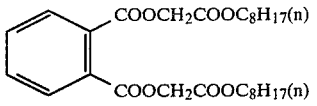

The silver halide photographic light-sensitive material of the present invention is allowed to be any kind if it comprises a support having thereon at least one silver halide emulsion layer, and no special restrictions are put on the coating order and the number of the silver halide emulsion layers and nonlight-sensitive layers as auxiliary layers. Typical examples of the silver halide photographic light-sensitive material of the present invention include color positive or negative film, color photographic printing paper, color slides, and dye image-forming monochromatic light-sensitive materials, and particularly the light-sensitive material of the present invention is suitable for use as color photographic printing paper. Usually, the foregoing silver halide emulsion layers and nonlight-sensitive layers are mostly hydrophilic binder-containing hydrophilic colloidal layers. As the hydrophilic binder there may be suitably used gelatin or such gelatin derivatives as acylated gelatin, guanidinylated gelatin, carbamylated gelatin, cyanoethanolated gelatin, esterified gelatin, and the like.

The cyan coupler having Formula [I] in the present invention (hereinafter referred to as the cyan coupler of the present invention) may be dispersed by use of the high-boiling organic solvent having Formula [II] (hereinafter referred to as the high-boiling organic solvent of the present invention) into a silver halide emulsion in the same manner as used for ordinary cyan dye-forming couplers, and the resulting emulsion is then coated as layers on a support, thereby producing a silver halide photographic light-sensitive material.

This silver halide photographic light-sensitive material is allowed to be either a monochromatic silver halide photographic light-sensitive material or a multicolor silver halide photographic light-sensitive material. In the case of the multicolor silver halide photographic light-sensitive material, the cyan coupler of the present invention is generally incorporated into a red-sensitive silver halide emulsion layer, but may also be allowed in a nonlight-sensitive layer or non-red-sensitive silver halide emulsion layers having sensitivities to the non-red regions of the three primary color regions of the spectrum. The respective component layer units each is comprised of a single emulsion layer or a plurality of emulsion layers having sensitivity to a specified region of the spectrum.

The incorporation of the cyan coupler of the present invention can be carried out by following any of those methods of the prior art. For example, the cyan coupler of the present invention is dissolved into separate or a mixture of the high-boiling organic solvent of the present invention and a low-boiling organic solvent typified by methyl acetate, ethyl acetate, propyl acetate, butyl acetate, butyl propionate, cyclohexanol, cyclohexane, tetrahydrofuran, methyl alcohol, acetonitrile, dimethyl formamide, dioxane, methyl-ethyl ketone, methyl-isobutyl ketone, diethylene-glycol monoacetate, acetylacetone, nitromethane, carbon tetrachloride, chloroform, and the like, and the solution is then mixed with an aqueous gelatin solution containing a surfactant. The mixture is subsequently emulsified to be dispersed by dispersing means of a mixer, a homogenizer, a colloid mill, flow-jet mixer or ultrasonic homogenizer, and after that the resulting dispersed liquid is added to a silver halide emulsion to thereby prepare the objective silver halide emulsion for use in the present invention. After or concurrent with the dispersion there may be provided a process for removing the low-boiling organic solvent.

In the present invention, the proportion of the high-boiling organic solvent of the present invention to the low-boiling organic solvent is preferably from 1:0.1 to 1:50, and more preferably from 1:1 to 1:20.

As the surfactant usable in the present invention there may be used anionic surfactants such as, for example, alkylbenzenesulfonates, alkylnaphthalenesulfonates, alkylsulfonates, alkylsulfates, alkylphosphates, sulfonsuccinates, sulfoalkylpolyoxyethylenealkylphenylether, and the like; nonionic surfactants such as, e.g., steroid-type saponin, alkyleneoxide derivatives, glycidol derivatives, and the like; amphoteric surfactants such as, e.g., amino acids, aminoalkylsulfonates, alkylbetaines, and the like; and cationic surfactants such as, e.g., quaternary ammonium salts and the like.

Examples of these surfactants are described in the "Kaimen-kasseizai-benran" ("Handbook of Surface-Active Agents") (Sangyo-tosho 1966) and the "Nyukazai, nyuka-sochi kenkyu, gijutsu-deita-shu" ("Studies and Technical Data on Emulsifying Agents and Emulsifying Apparatus")(Kagaku-hanron Sha 1978).

To the cyan coupler of the invention and the high-boiling organic solvent may, if necessary, be added concurrently other hydrophobic compounds such as, for example, hydroquinone derivatives, ultraviolet absorbing agents, antidiscoloration agents, coloring matters, and the like.

In the case where the silver halide photographic light-sensitive material is a multicolor element, the necessary layers for the photographic element including the above-described image-forming component units may be provided in various orders as is known to those skilled in the art. The typical multicolor silver halide photographic light-sensitive material comprises a support having thereon a cyan dye image-formable component unit comprising at least one red-sensitive silver halide emulsion layer containing a cyan dye-forming coupler (containing at least one cyan dye forming coupler having Formula [I] of the present invention and at least one compound having Formula [II] of the present invention); a magenta dye image-formable component unit comprising at least one green-sensitive silver halide emulsion layer containing at least one magenta dye-forming coupler; and an yellow dye image-formable component unit comprising at least one blue-sensitive silver halide emulsion layer containing at least one yellow dye-forming coupler.

The photographic element is allowed to have such additional nonlight-sensitive layers as, e.g., filter layers, interlayers, a protective layer, an antihalation layer, a subbing layer, and the like.

As the yellow dye-forming coupler for use in the present invention, there may be suitably used those compounds having the following Formula [IV]:

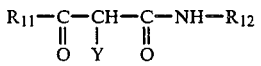

Formula [IV]

wherein $R_{11}$ is an alkyl radical (e.g., methyl, ethyl, propyl, butyl, etc.) or an aryl radical (e.g., phenyl, p-methoxyphenyl, etc.); $R_{12}$ is an aryl radical; and Y is a hydrogen atom or a radical that can be split off during the course of a color developing reaction. Further, the particularly preferred yellow coupler for the dye image formation in the present invention are those having the following Formula [V]:

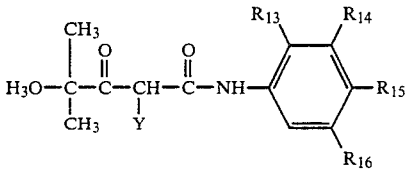

Formula [V]

wherein $R_{13}$ is a halogen atom, an alkoxy radical or an aryloxy radical; $R_{14}$, $R_{15}$ and $R_{16}$ each is a hydrogen atom, a halogen atom, an alkyl radical, an alkenyl radical, an alkoxy radical, an aryl radical, an aryloxy radical, a carbonyl radical, a sulfonyl radical, a carboxy radical, an alkoxycarbonyl radical, a carbamyl radical, a sulfone radical, a sulfamyl radical, a sulfonamido radical, an acylamido radical, an ureido radical or an amino radical; and Y is as defined previously.

These are as described in, e.g., U.S. Pat. Nos. 2,778,658, 2,875,057, 2,908,573, 3,227,155, 3,227,550, 3,253,924, 3,265,506, 3,277,155, 3,341,331, 3,369,895, 3,384,657, 3,408,194, 3,415,652, 3,447,928, 3,551,155, 3,582,322, 3,725,072 and 3,894,875; West German OLS Pat. Nos. 1,547,868, 2,057,941, 2,162,899, 2,163,812, 2,213,461, 2,219,917, 2,261,361 and 2,263,875; Japanese Patent Examined Publication No. 13576/1974; Japanese Patent O.P.I. Publication Nos. 29432/1973, 6834/1973, 10736/1974, 122335/1974, 28834/1975 and 132926/1975.

As the dye image-formable coupler, there may be suitably used those couplers having the following Formula [VI]:

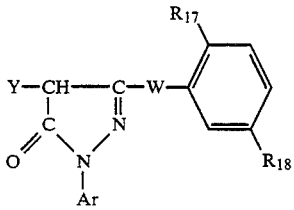

Formula [VI]

wherein Ar is an alkyl radical; $R_{17}$ is a hydrogen atom, a halogen atom, an alkyl radical or an alkoxy radical; $R_{18}$ is an alkyl radical, an amido radical, an imido radical, an N-alkylcarbamoyl radical, an N-alkylsulfamoyl radical, an alkoxycarbamoyl radical, an acyloxy radical, a sulfonamido radical or an urethane radical; Y is as defined in Formula [V]; and W is —NH—, —NHCO— (wherein the N atom is bonded with the carbon atom of the pyrazolone nucleus) or —NHCONH—.

These are as described in, e.g., U.S. Pat. Nos. 2,600,788, 3,061,432, 3,062,653, 3,127,269, 3,311,476, 3,152,896, 3,419,391, 3,519,429, 3,555,318, 3,684,514, 3,888,680, 3,907,571, 3,928,044, 3,930,861, 3,930,866 and 3,933,500; Japanese Pat. O.P.I. Publication Nos. 29639/1974, 111631/1974, 129538/1974, 13041/1975, 58922/1977, 62454/1980, 118034/1980 and 38043/1981; British Pat. No. 1,247,493; Belgian Pat. Nos. 769,116 and 792,525; West German Pat. No. 2,156,111; and Japanese Patent Examined Publication No. 60479/1971.

The following are examples of the suitably usable yellow and magenta dye-forming couplers in the present invention, but the present invention is not limited thereto.

Yellow Couplers:

Y-1: α-benzoyl-2-chloro-5-[α-(dodecyloxycarbonyl)-ethoxycarbonyl]-acetanilide.

Y-2: α-benzoyl-2-chloro-5-[γ-(2,4-di-t-amylphenoxy)-butylamido]acetanilide.

Y-3: α-fluoro-α-pivalyl-2-chloro-5-[γ-(2,4-di-t-amylphenoxy)butylamido]-acetanilide.

Y-4: α-pivalyl-α-stearoyloxy-4-sulfamoyl-acetanilide.

Y-5: α-pivalyl-α-[4-(4-benzyloxydiphenylsulfonyl)-phenoxy]-2-chloro-5-[γ-(2,4-di-t-amylphenoxy)-butylamido]-acetanilide.

Y-6: α-(2-methoxybenzoyl)-α-(4-acetoxyphenoxy)-4-chloro-2-(4-t-octylphenoxy)-acetanilide.

Y-7: α-pivalyl-α-(3,3-dipropyl-2,4-dioxoacetidin-1-yl)-2-chloro-5-[α-(dodecyloxycarbonyl)-ethoxycarbonyl]-acetanilide.

Y-8 α-pivalyl-α-succinimido-2-chloro-5-[γ-(2,4-di-t-amylphenoxy)butylamido]-acetanilide.

Y-9: α-pivalyl-α-(3-tetradecyl-1-succinimido)-acetanilide.

Y-10: Dipotassium α-(4-dodecyloxybenzoyl)-α-(3-methoxy-1-succinimido)-3,5-dicarboxyacetanilide.

Y-11: α-pivalyl-α-phthalmido-2-chloro-5-[α-2,4-di-t-amylphenoxy)butylamido]-acetanilide.

Y-12: α-2-furyl-α-phthalimido-2-chloro-5-[γ-(2,4-di-t-amylphenoxy)butylamido]-acetanilide.

Y-13: α-3-[α-(2,4-di-t-amylphenoxy)butylamido]-benzoyl-α-succinimido-2-methoxyacetanilide.

Y-14: α-phthalimido-α-pivalyl-2-methoxy-4-[(N-methyl-N-octadecyl)-sulfamoyl]-acetanilide.

Y-15: α-acetyl-α-succinimido-2-methoxy-4-[(N-methyl-octadecyl)sulfamoyl]-acetanilide.

Y-16: α-cyclobutyryl-α-(3-methyl-3-ethyl-1-succinimido)-2-chloro-5-[(2,5-di-t-amylphenoxy)-acetamido]-acetanilide.

Y-17: α-(3-octacecyl-1-succinimido-α-propenoyl-acetanilide.

Y-18: α-(2,6-di-oxo-3-n-propyl-piperidine-1-yl)-αα-pivalyl-2chloro-5-[γ-(2,4-di-t-amylphenoxy)butylcarbamoyl]-acetanilide.

Y-19: α-(1-benzyl-2,4-dioxo-imidazolidine-3-yl)-α-pivalyl-2chloro-5-[γ-(2,4-di-t-amylphenoxy)butylamido]-acetanilide.

Y-20: α-(1-benzyl-2-phenyl-3,5-dioxo-1,2,4-triazine-4-yl)-α-pivalyl-2-chloro-5-[γ-(2,4-di-t-amylphenoxy)-butylamido] actanilide.

Y-21: α-(3,3-dimethyl-1-succinimido)-α-pivalyl-2-chloro-5-[α-(2,4-di-t-amylphenoxy)butylamido]-acetanilide.

Y-22: α-[3-(p-chlorophenyl)-4,4-dimethyl-2,5-dioxo-1-imidazolyl]-α-pivalyl-2-chloro-5-[γ-(2,4-di-t-amylphenoxy)butylamido]-acetanilide.

Y-23: α-pivalyl-α-(2,5-dioxo-1,3,4-triazine-1-yl)-2-methoxy-5-[α-(2,4-di-t-amylphenoxy)butylamido]-acetanilide.

Y-24: α-(5-benzyl-2,4-dioxo-3-oxazoyl)-α-pivalyl-2-chloro-5[γ-(2,4-di-t-amylphenoxy)butylamido]-acetanilide.

Y-25: α-(5,5-dimethyl-2,4-dioxo-3-oxazoyl)-α-pivalyl-2-chloro-5-[α-(2,4-di-t-amylphenoxy)butylamido]-acetanilide.

Y-26: α-(3,5-dioxo-4-oxazinyl)-α-pivalyl-2-chloro-5-[γ-(2,4-di-t-amylphenoxy)butylamido]-acetanilide.

Y-27: α-pivalyl-α-(2,4-dioxo-5-methyl-3-thiazolyl)-2-chloro-5-[γ-(2,4-di-t-amylphenoxy)butylamido]-acetanilide.

Y-28: α-[3(2H)-pyridazone-2-yl]-α-pivalyl-2-chloro-5-[γ-(2,4-di-t-amylphenoxy)butylamido]-acetanilide.

Y-29: α-[4,5-dichloro-3(2H)-pyridazone-2-yl]-α-benzoyl-2-chloro-5-[α-(dodecyloxycarbonyl)-ethoxycarbonyl]-acetanilide.

Y-30: α-(1-phenyl-tetrazole-5-oxy)-α-pivalyl-2-chloro-5-[γ-(2,4-di-t-amylphenoxy)butylamido]-acetanilide.

Y-31: 4,4-di-(acetacetamino)-3,3-dimethyl-diphenylmethane.

Y-32: p,p'-di-(acetacetamino)diphenyl-methane.

Magenta Couplers:

M-1: 1-(2,4,6-trichlorophenyl)-3-(2-chloro-5-octadecylcarbamoyl-anilino)-5-pyrazolone.

M-2: 1-(2,4,6-trichlorophenyl)-3-(2-chloro-5-tetradecaneamidoanilino)-5-pyrazolone.

M-3: 1-(2,4,6-trichlorophenyl)-3-[2-chloro-5-α-(2,4-di-t-amylphenoxy)butylcarbamoyl]-anilino-5-pyrazolone.

M-4: 1-(2,4,6-trichlorophenyl)-4-chloro-3-[2-chloro-5-γ-(2,4di-t-amylphenoxy)butylcarbamoyl]-anilino-5-pyrazolone.

M-5: 1-(2,4,6-trichlorophenyl)-4-diphenylmethyl-3-[2-chloro-5-(γ-octadecinylsuccinimido)propylsulfamoyl]-anilino-5-pyrazolone.

M-6: 1-(2,4,6-trichlorophenyl)-4-acetoxy-5-(2-chloro-5-tetradecaneamido)-anilino-5-pyrazolone.

M-7: 1-[γ-(3-pentadecylphenoxy)butylamido]-phenyl-3-anilino-4-(1-phenyl-tetrazole-5-thio)-5-pyrazolone.

M-8: 1-(2,4,6-trichlorophenyl)-3-(2-chloro-5-octadecylsuccinimido)-anilino-5-pyrazolone.

M-9: 1-(2,4,6-trichlorophenyl)-3-(2-chloro-5-octadecenylsuccinimido)-anilino-5-pyrazolone.

M-10: 1-(2,4,6-trichlorophenyl)-3-[2-chloro-5-(N-phenyl-N-octylcarbamoyl)]-anilino-5-pyrazolone.

M-11: 1-(2,4,6-trichlorophenyl)-3-[2-chloro-5-(N-butylcarbonyl)pyrazinylcarbonyl]-anilino-5-pyrazolone.

M-12: 1-(2,4,6-trichloropheny)-3-[2-chloro-5-(2,4-dicarboxy- 5-phenylcarbamoyl)-benzylamido]-anilino-5-pyrazolone.

M-13: 1-(2,4,6-trichlorophenyl)-3-(4-tetradecylthiomethylsuccinimido)-anilino-5-pyrazolone.

M-14: 1-(2,4,6-trichlorophenyl)-3-[2-chloro-4-(2-benzofurylcarboxyamido)]-anilino-5-pyrazolone.

M-15: 1-(2,4,6-trichlorophenyl)-3-{2-chloro-4-[γ-(2,2-dimethyl-6-octadecyl-7-hydroxy-chroman-4-yl)-propionamido]}-anilino-5-pyrazolone.

M-16: 1-(2,4,6-trichlorophenyl)-3-[2-chloro-5-(3-pentadecylphenyl)-phenylcarbonylamido]-anilino-5-pyrazolone.

M-17: 1-(2,4,6-trichlorophenyl)-3-{2-chloro-5-[2-(3-t-butyl-4-hydroxyphenoxy)-tetradecaneamido]-anilino}-5-pyrazolone.

M-18: 1-(2,6-dichloro-4-methoxyphenyl)-3-(2-methyl-5-tetradecaneamido)-anilino-5-pyrazolone.

M-19: 4,4'-benzilidene-bis-[1-(2,4,6-trichlorophenyl)-3-{2-chloro-4-[γ-(2,4-di-t-amylphenoxy)butylamido]-anilino}-5-pyrazolone.

M-20: 4,4'-benzilidene-bis-[1-(2,3,4,5,6-pentachlorophenyl)-3-2-chloro-5-[γ-(2,4-di-t-amylphenoxy)-butylamido]-anilino-5-pyrazolone.

M-21: 4,4'-(2-chloro)benzilidene-bis-[1-(2,4,6-trichlorophenyl)-3-(2-chloro-5-dodecylsuccinimido)-anilino-5-pyrazolone].

M-22: 4,4'-benzilidene-bis[1-(2-chlorophenyl)-3-(2-methoxy-4hexadecaneamido)-anilino-5-pyrazolone].

M-23: 4,4'-methylene-bis[1-(2,4,6-trichlorophenyl)-3-(2-chloro- 5-dodecenylsuccuinimido)-anilino-5-pyrazolone)].

M-24: 1-(2,4,6-trichlorophenyl)-3-[3-(2,4-di-t-amylphenoxyacetamido)benzamido]-5-pyrazolone.

M-25: 3-ethoxy-1-4-[α-(3-pentadecylphenoxy)-butylamido]phenyl-5-pyrazolone.

M-26: 1-(2,4,6-trichlorophenyl)-3-[2-chloro-5-{α-(3-t-butyl-4-hydroxy)phenyl}-tetradecaneamido]-anilino-5-pyrazolone.

M-27: 1-(2,4,6-trichlorophenyl)-3-3-nitoanilino-5-pyrazolone.

Any of these yellow dye-forming couplers and magenta dyeforming couplers is to be contained in a silver halide emulsion layer in a quantity of from 0.05 to 2 moles per mole of silver halide.

As the support material used in the present invention there may be used such a material as, e.g., baryta paper, polyethylene-coated paper, polypropylene synthetic paper, a transparent support having thereon a reflective layer or reflective material, a glass plate, cellulose acetate, cellulose nitrate, polyester film such as polyethylene terephthalate film, polyamide film, polycarbonate film, polystyrene film, or the like. These support materials may be arbitrarily selected according to the purpose for which is used the silver halide photographic light-sensitive material of the present invention.

The coating of the silver halide emulsion layers and non-light-sensitive layers used in the present invention can be carried out by various such coating methods as the dipping coating process, air-doctor coating process, curtain coating process, hopper coating process, and the like.

The silver halide for use in the silver halide emulsion of the present invention includes such silver halides arbitrarily used for ordinary silver halide emulsions as silver bromide, silver chloride, silver iodobromide, silver chlorobromide, silver chloroiodobromide, and the like. These silver halide particles may be either coarse-grained or fine-grained, and the particle size destribution may be either wider or narrower. The crystal of these silver halide particles may be either regular or twin, having an arbitrary proportion of the [100] face to the [111] face. Further, the structure of these silver halide particles may be either homogeneous from the inside to the outside or heterogeneous between the inside and the outside. Furthermore, these silver halide particles may be either of the type of forming a latent image mainly on the surface thereof or of the type of forming a latent image thereinside. Still further, these silver halides may be prepared by any such methods as the neutral method, ammoniacal method, or acid method, and also may be mixed by any of the simultaneously mixing method, sequentially mixing method, inversely mixing method or conversion method.

The silver halide emulsion of the present invention may be chemically sensitized by the single or combined use of those sensitizers including sulfur sensitizers such as, e.g., arylthiocarbamides, thiourea, cystine, etc.; active or inert selenium sensitizers; reduction sensitizers such as stannous salts, polyamides, etc.; noble-metallic sensitizers such as, e.g., gold sensitizers including potassium aurithiocyanate, potassium chloroaurate, 2-aurosulfobenzthiazole-methyl-chloride, etc.; water-soluble salts of ruthenium, rhodium, iridium, palladium, such as ammonium chloropalladate, potassium chloroplatinate, sodium chloropalladite, etc.; and the like.

The silver halide emulsion of the present invention may contain various known photographic additives.

The silver halide of the present invention, in order to be provided with sensitivity to a necessary wavelength region for a red-sensitive emulsion, is spectrally sensitized by the addition thereto of an appropriately selected sensitizing dye. As the sensitizing dye there are used various kinds, and they may be used singly or in combination of not less than two.

The typical spectral sensitizing dye advantageously usable in the present invention includes those cyanine dyes, merocyanine dyes and complex cyanine dyes as described in, e.g., U.S. Pat. Nos. 2,270,378, 2,442,710 and 2,454,620.

The silver halide emulsion layers and nonlight-sensitive layers of the silver halide photographic light-sensitive material of the present invention are allowed to contain various other photographic additives such as, e.g., antifoggants, anticolor-stain agents, brightening agents, antistatic agents, hardening agents, plasticizers, wetting agents, ultraviolet absorbing agents, and the like.

The thus constructed silver halide photographic light-sensitive material of the present invention is exposed to light, and then may be processed in various photographic manners as color development.

The preferred color developer liquid for use in the present invention contains as the principal component thereof an aromatic primary amine-type color developing agent, whose typical examples are p-phenylenediamine-type compounds such as, e.g., diethyl-p-phenylenediamine hydrochloride, monomethylp-phenylenediamine hydrochloride, dimethyl-p-phenylenediamine hydrochloride, 2-amino-5-diethylaminotoluene hydrochloride, 2-amino-5-(N-ethyl-N-dodecylamino)-toluene, 2-amino-5-(N-ethyl-N-$\beta$-methanesulfonamidoethyl)aminotoluene sulfate, 4-(N-ethyl-N-$\beta$-methanesulfonamidoethylamino)aniline, 4-(N-ethyl-N-$\beta$-hydroxyethylamino)aniline, 2-amino-5-(N-ethyl-$\beta$-methoxyethyl)aminotoluene, and the like.

These color developing agents may be used sinly or in combination of not less than two, or, if necessary, together with a black-and-white developing agent such as hydroquinone. Further, the color developer liquid contains generally alkali agents such as sodium hydroxide, ammonium hydroxide, sodium carbonate, sodium sulfite, and the like, and, in addition, various additives including a halogenated alkali metal such as, e.g., potassium bromide; a development control agent such as, e.g., hydrazinic acid; and the like.

The silver halide photographic light-sensitive material of the present invention may contain in the hydrophilic colloidal layer thereof the above-described color developing agent as it is or in the form of the precursor thereof. The color developing agent precursor is a compound capable of producing a color developing agent under an alkaline condition, and includes aromatic aldehyde derivative-combined Schiff's base-type precursors, multivalent metal ion complex precursors, phthalic acid imide derivative precursors, phosphoric acid imide derivative precursors, sugar-amine reaction product precursors and urethane-type precursors. These aromatic primary amine-type color developing agent precursors are as described in, e.g., U.S. Pat. Nos. 3,342,599, 2,507,114, 2,695,234 and 3,719,492; British Pat. No. 803,783; Japanese Patent O.P.I. Publication Nos. 135628/1978 and 79035/1979; and Research Disclosure Nos. 15159, 12146 and 13924.

Any of these aromatic primary amine-type developing agents or precursors thereof should be added in such a quantity that a sufficient color can be formed during the color developing process. The quantity largely differs depending on the kind of the light-sensitive material used, but may be in the range of from about 0.1 mole to about 5 moles, and preferably from 0.5 mole to 3 moles per mole of light-sensitive silver halide. These color developing agents or precursors thereof may be used singly or in combination. The incorporation of any of the foregoing compounds into the silver halide photographic light-sensitive material can be carried out by the addition thereto of a solution of the compound dissolved into such an appropriate solvent as water, methanol, ethanol, acetone, or the like; or of a emulsifiedly dispersed liquid of the compound dispersed by use of such a high-boiling organic solvent as dibutyl phthalate, dioctyl phthalate, tricresyl phosphate, or the like; or of the compound in the form of being impregnated into a latex polymer.

The silver halide photographic light-sensitive material of the present invention, after a color development, is processed in bleaching and fixing baths separately or in a combined bleach-fix bath, and then washed. The bleaching agent applicable to the above processing includes a large variety of compounds, and especially such multivalent metallic compounds as of iron (III), cobalt (III), tin (II), etc.; above all, complex salts of these multivalent metallic cations with organic acids such as, for example, metallic salts of ethylenediaminetetraacetic acid, nitrilotriacetic acid, aminopolycarboxylic acids such as N-hydroxyethylethylenediaminediacetic acid, malonic acid, tartaric acid, malic acid, diglycolic acid, dithioglycolic acid, and the like; ferricyanates, bichromates; chromates; and the like, may be used singly or in an appropriate combination.

The silver halide photographic light-sensitive material of the present invention is excellent in the cyan coupler's dispersion stability and capable of forming a dye image improved so as to have a satisfactory image preservability without impairing the photographic characteristics; especially the material is improved so as to have well-balanced resistances to light, heat and moisture as well as to form a dye image well-preservable under high temperature-humidity conditions and markedly improved on the light-discoloration characteristic.

The present invention will be illustrated further in detail with reference to examples below, but embodiments of the present invention are not limited thereto.

EXAMPLE 1

A monochromatic photographic element samples having component layers as given in Table 1 were prepared.

TABLE

| | | Coated quantity of Ag | Coated quantity of gelatin | Coupler | High-boiling organic solvent |
|---|---|---|---|---|---|
| Layer 2 | Protective layer | — | 20 | | |
| Layer 1 | Red-sensitive EM layer | 4.0 | 20 | (1-5) 7.0 | see Table 2 4.2 |
| | Coated on polyethylene-coated paper support | | | | |

Coating quantity unit: mg/100 $cm^2$

Each of the cyan coupler-dispersed liquids to be incorporated into Layer 1 was prepared in the following steps (a) to (c):

(a) Thirty-three grams of Exemplified Coupler I-5, 0.45 g of 2,5-di-t-octyl-hydroquinone, 26.4 g of each of the high-boiling organic solvents as given in Table 2, and 60 g of ethyl acetate were mixed and dissolved by heating up to 60° C.

(b) Forty grams of photographic gelatin are mixed into 500 ml of pure water at room temperature, and swelled, spending n 20 minutes, and then dissolved by heating to 60° C. After that, to the gelatin solution are added 50 ml of an aqueous 5% Alkanol B (produced by DuPont) solution, and the mixture is stirred until it becomes homogeneous.

(c) The respective solutions obtained in (a) and (b) are mixed, and then dispersed by means of an ultrasonic homogenizer, spending 30 minutes, thereby obtaining a dispersed liquid.

The thus obtained 15 different samples were subjected to the following tests (1) to (3). The obtained results are as shown in Table 2.

(1) Stability test of coupler dispersion

Each of the dispersed liquids prepared in the above steps (a) to (c) was tested for its turbidity (the turbidity has correlation with the dispersed particle size; the smaller the turbidity, the smaller the particle size) and the particle's deposition degree (deposition starting time) on the surface. The liquid samples each was allowed to stand for 10 hours at 40° C. without stirring.

(2) Sensitometry—photographic characteristics tests

Each of the 15 monochromatic photographic element samples was exposed through an optical wedge to white light by use of a sensitometer (Model KS-7, manufactured by Konishiroku Photo Industry Co., Ltd.), and then processed in the following baths in accordance with the processing steps below:

| Processing steps | Time | Temperature |
|---|---|---|
| Color developing | 3.5 minutes | 33° C. |
| Bleach-fix | 1.5 minutes | 33° C. |
| Washing | 3.0 minutes | 33° C. |
| Drying | — | 80° C. |

Composition of Color Developer:

| | |
|---|---|
| Pure water | 700 ml |
| Benzyl alcohol | 15 ml |
| Diethylene glycol | 15 ml |
| Hydroxylamine sulfate | 2 g |
| N—ethyl-N—β-methanesulfonamidoethyl-3-methyl-4-aminoaniline sulfate | 4.4 g |
| Potassium carbonate | 30 g |
| Potassium bromide | 0.4 g |
| Potassium chloride | 0.5 g |
| Potassium sulfite | 2 g |
| Pure water to make 1 liter (pH = 10.2) | |

Composition of Bleach-Fix Bath:

| | |
|---|---|
| Iron-ammonium ethylenediaminetetraacetate | 61 g |
| Diammonium ethylenediaminetetraacetate | 5 g |
| Ammonium thiosulfate | 125 g |
| Sodium metabisulfite | 13 g |
| Sodium sulfite | 2.7 g |
| Water to make 1 liter (pH = 7.2) | |

Each of the processed samples was measured with respect to its relative speed, maximum reflection density and gamma(γ) by use of a photo-electric densitometer (Model PDA-60, manufactured by Konishiroku Photo Industry Co., Ltd.). The measured results are as given in Table 2.

(3) Tests of dye image lasting properties

Each of the 15 monochromatic photographic element samples processed under the same condition was tested with respect to its tests of dye image lasting properties under the following conditions

| | Illuminance (Lux) | Irradiation time (Hr) |
|---|---|---|
| (i) Light-discoloration characteristic: | | |
| A Xenon fadeometer | $3.5 \times 10^4$ | 100 |
| B Fluorescent lamp fadeometer | $1.6 \times 10^4$ | 300 |
| (ii) Dark-discoloration characteristic: | | |
| Aging conditions | | |
| C 77° C. | without humidification | for 14 days |
| D 70° C. | 80% relative humidity | for 14 days |

The dye image lasting properties data of each of the samples are indicated in Table 2 with percentage (%) of the density after the experiment (D) to the initial density (Do) = 1.0

TABLE 2

| Sample No. | High-boiling organic solvent | Turbidity (ppm): Right after dispersion | Turbidity (ppm): After 10 hrs | Turbidity (ppm): difference | Deposition starting time (Hr) | Photographic characteristics: Relative speed | Photographic characteristics: Maximum reflection density | Photographic characteristics: Gamma (γ) | Light discoloration A | Light discoloration B | Dark discoloration C | Dark discoloration D | |
|---|---|---|---|---|---|---|---|---|---|---|---|---|---|
| 1 | Dimethyl phthalate | 28.0 | 50.9 | 22.9 | 6.5 | 98 | 2.52 | 3.32 | 52 | 58 | 95 | 93 | Comparative |
| 2 | Diethyl phthalate | 29.0 | 50.6 | 21.6 | 5.5 | 99 | 2.53 | 3.35 | 54 | 60 | 93 | 92 | Comparative |
| 3 | Dipropyl phthalate | 29.2 | 50.8 | 21.6 | 5.5 | 98 | 2.53 | 3.44 | 55 | 62 | 93 | 92 | Comparative |
| 4 | Dibutyl phthalate | 27.2 | 51.5 | 24.4 | 5.0 | 100 | 2.55 | 3.51 | 54 | 60 | 94 | 93 | Comparative |

TABLE 2-continued

| Sample No. | High-boiling organic solvent | Turbidity (ppm) Right after dispersion | After 10 hrs | difference | Deposition starting time (Hr) | Photographic characteristics Relative speed | Maximum reflection density | Gamma (γ) | Light discoloration A | B | Dark discoloration C | D | |
|---|---|---|---|---|---|---|---|---|---|---|---|---|---|
| 5 | Diphenyl phthalate | 29.6 | 49.6 | 20.0 | 6.0 | 98 | 2.54 | 3.47 | 55 | 61 | 93 | 92 | Comparative |
| 6 | Dicyclohexyl phthalate | 28.4 | 49.2 | 20.8 | 6.0 | 97 | 2.53 | 3.36 | 54 | 61 | 94 | 93 | Comparative |
| 7 | Exemplified compound (II-2) | 28.1 | 39.5 | 11.4 | not less than 10 hrs | 99 | 2.56 | 3.49 | 68 | 77 | 97 | 96 | Invention |
| 8 | Exemplified compound (II-4) | 27.8 | 39.2 | 11.4 | not less than 10 hrs | 100 | 2.57 | 3.50 | 68 | 76 | 96 | 96 | Invention |
| 9 | Exemplified compound (II-13) | 27.9 | 37.8 | 9.9 | not less than 10 hrs | 101 | 2.55 | 3.55 | 70 | 78 | 96 | 95 | Invention |
| 10 | Exemplified compound (II-20) | 27.5 | 37.4 | 9.9 | not less than 10 hrs | 100 | 2.57 | 3.52 | 70 | 79 | 96 | 96 | Invention |
| 11 | Exemplified compound (II-24) | 27.7 | 37.9 | 10.2 | not less than 10 hrs | 102 | 2.56 | 3.57 | 69 | 78 | 97 | 96 | Invention |
| 12 | Tricresyl phosphate | 28.3 | 52.0 | 23.7 | 5.0 | 100 | 2.56 | 3.53 | 55 | 61 | 92 | 90 | Comparative |
| 13 | Benzyl benzoate | 29.1 | 51.8 | 22.7 | 5.5 | 99 | 2.56 | 3.40 | 53 | 59 | 93 | 92 | Comparative |
| 14 | Dioctyl sebacate | 30.8 | 51.6 | 20.8 | 6.5 | 98 | 2.50 | 3.31 | 55 | 60 | 93 | 92 | Comparative |
| 15 | Isopentyl butyrate | 30.4 | 51.9 | 21.5 | 5.5 | 98 | 2.51 | 3.30 | 51 | 56 | 94 | 91 | Comparative |

From the results given in Table 2, it is apparent that the silver halide photographic light-sensitive material samples of the present invention have remarkably improved dispersion stability of the cyan coupler as compared to the comparative (conventional) samples, and also show much improved light-discoloration characteristics and rather improved dark-discoloration characteristics with the sensitometric characteristics maintained on a high level.

EXAMPLE 2

Monochromatic photographic element samples similar to those of Example 1 were prepared in the same manner as in Example 1 with the exception that Exemplified Compound (II-4) of the present invention as a high-boiling organic solvent and those cyan couplers as given in Table 3 were used.

The thus obtained 10 different samples each was subjected to the same tests as performed in Example 1. The obtained results are as shown in Table 3.

The comparative couplers 1 to 4 shown in Table 3 are the following compounds:

Comparative Coupler-1

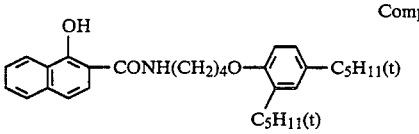

Comparative Compound-2

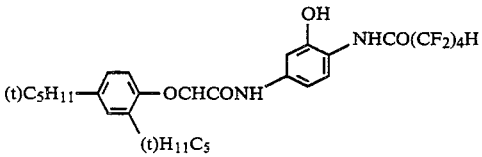

-continued

Comparative Compound-3

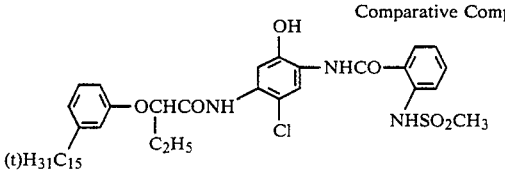

Comparative Compound-4

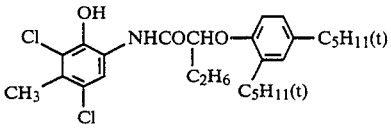

TABLE 3

| Sample No. | Cyan coupler | Light discoloration A | B | Dark discoloration C | D | |
|---|---|---|---|---|---|---|
| 16 | Comparative coupler-1 | 53 | 57 | 65 | 69 | comparative |
| 17 | Comparative coupler-2 | 47 | 52 | 96 | 96 | comparative |
| 18 | Comparative coupler-3 | 55 | 60 | 96 | 96 | comparative |
| 19 | Exemplified coupler (I-4) | 71 | 78 | 96 | 96 | Invention |
| 20 | Exemplified coupler (I-5) | 68 | 76 | 96 | 96 | Invention |
| 21 | Exemplified coupler (I-6) | 69 | 78 | 96 | 96 | Invention |
| 22 | Exemplified coupler (I-16) | 72 | 78 | 97 | 96 | Invention |
| 23 | Exemplified coupler (I-32) | 74 | 80 | 96 | 96 | Invention |
| 24 | Comparative coupler 4 Exemplified coupler (I-5) | 70 | 78 | 96 | 96 | Invention |
| 25 | Comparative coupler 4 Exemplified coupler (I-6) | 72 | 79 | 95 | 96 | Invention |

In addition, the coated quantities of the cyan coupler were 7.0 mg/100 cm$^2$ for Samples 16–23; 1.0 mg/100

$cm^2$ for Comparative coupler-4 and 5.6 mg/100 $cm^2$ for Exemplified coupler (I-5) of Sample 24; and 2.0 mg/100 $cm^2$ for Comparative coupler-4 and 4.2 mg/100 $cm^2$ for Exemplified coupler (I-6) of Sample 25.

As apparent from Table 3, the silver halide photographic light-sensitive material samples of the present invention are markedly improved in the ligh-discoloration characteristic as well as in the dark-discoloration characteristic.

EXAMPLE 3

Multicolor photographic element samples having the construction shown in Table 4 were prepared

TABLE 4

| | | Coated q'ty of silver | Coated q'ty of gelatin | Coated q'ty of UV agent | Kind & coated quantity of coupler | Hi-boiling organic solvent |
|---|---|---|---|---|---|---|
| Layer 6 | Protective layer | — | 15 | — | | — |
| Layer 5 | Red-sensitive EM layer | 3.0 | 20 | — | Table 5<br>7.0 | Table 5<br>5.0 |
| Layer 4 | Interlayer | — | 20 | 6.0 | — | DBP 5.0 |
| Layer 3 | Green-sensitive EM layer | 3.0 | 20 | — | (M-9)<br>6.1 | TCP 5.0 |
| Layer 2 | Interlayer | — | 10 | — | — | — |
| Layer 1 | Blue-sensitive EM layer | 4.0 | 20 | — | (Y-19)<br>10.0 | DBP 6.0 |

In the above table, the coated quantities are indicated in mg/100 $cm^2$. DBP stands for dibutyl phthalate, and TCP for tricresyl phosphate. Couplers M-1 and M-2, and ultraviolet absorbing agents (UV agents) UV-1 and UV-2 are the following compounds. The UV-1 and UV-2 were used in combination in the proportion of 1:1.

Ultraviolet absorbing atents:

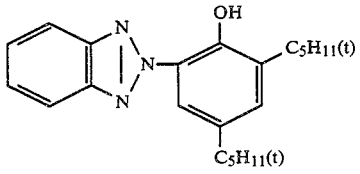

UV-1

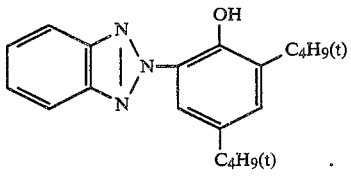

UV-2

The thus obtained five samples each was exposed to blue, green and red lights separately, and then processed in the same manner as in Example 1, thus preparing yellow(Y)-magenta (M)-cyan(C) three color-separation samples. These samples each was subjected to the same dye image lasting properties tests as performed in Example 1. The test results are as shown in Table 5.

TABLE 5

| Sample No. | Cyan coupler | High-boiling organic solvent | Cyan: Light discoloration A | Cyan: Light discoloration B | Cyan: Dark discoloration C | Cyan: Dark discoloration D | Magenta: Light discoloration A | Magenta: Light discoloration B | Magenta: Dark discoloration C | Magenta: Dark discoloration D | Yellow: Light discoloration A | Yellow: Light discoloration B | Yellow: Dark discoloration C | Yellow: Dark discoloration D |
|---|---|---|---|---|---|---|---|---|---|---|---|---|---|---|
| 26 (comparative) | Exemplified coupler (I-5) | DBP | 54 | 60 | 94 | 93 | 70 | 82 | 84 | 85 | 66 | 81 | 92 | 81 |
| 27 (invention) | Exemplified coupler (I-5) | Exemplified compound (II-2) | 70 | 78 | 95 | 97 | 70 | 82 | 84 | 85 | 67 | 81 | 92 | 82 |
| 28 (invention) | Exemplified coupler (I-5) | Exemplified compound (II-4) | 71 | 79 | 95 | 97 | 70 | 82 | 85 | 85 | 66 | 82 | 93 | 82 |
| 29 (invention) | Exemplified coupler (I-6) | Exemplified compound (II-2) | 71 | 80 | 96 | 97 | 71 | 82 | 85 | 85 | 66 | 82 | 92 | 81 |
| 30 (invention) | Exemplified coupler (I-6) | Exemplified compound (II-4) | 71 | 81 | 95 | 96 | 70 | 83 | 85 | 85 | 67 | 82 | 92 | 82 |

As apparent from the results shown in Table 5, the silver halide photographic light-sensitive material samples of the present invention show remarkably improved cyan coupler's light-discoloration characteristics and dark-discoloration characteristics under high temperature-humidity conditions.

What is claimed is:

1. A silver halide photographic light-sensitive material comprising a support having thereon at least one silver halide emulsion, said silver halide emulsion layer containing at least one cyan coupler having the following Formula I, said cyan coupler being dispersed into said silver halide emulsion layer by the use of at least one high-boiling solvent having the Formula II:

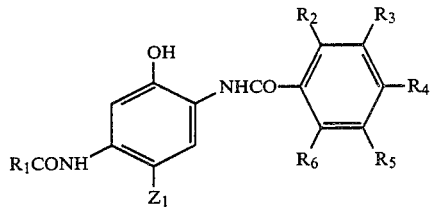

I wherein $R_1$ is a substituted or unsubstituted alkyl or substituted or unsubstituted aryl; $R_3$, $R_4$, and $R_5$ each is a radical selected from the group consisting of hydrogen, halogen, hydroxyl, nitro, cyano, alkyl, alkoxy, aryl, aryloxy, alkylsulfamoyl, arylsulfamoyl, alkyloxycarbonyl, aryloxycarbonyl, alkylsulfonyl and arylsulfonyl radicals; $R_2$ and $R_6$ are each selected from H, halogen, alkyl, and alkoxy; and $Z_1$ is a hydrogen atom, a halogen atom, or a radical that can be split off by the reaction of said coupler with the oxidized product of an aromatic primary amine-type color developing agent,

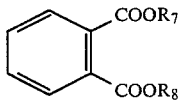

II wherein $R_7$ and $R_8$ each is an alkyl radical, an alkenyl radical or an aryl radical, provided that the sum of the carbon atoms of the radicals represented by $R_7$ and $R_8$ is from 16 to 36.

2. The silver halide photographic light-sensitive material of claim 1, wherein said alkyl radical represented by the $R_1$ of Formula [I] is an alkyl that is substituted by a phenoxy radical, an arylsulfonyl radical or an arylthio radical.

3. The silver halide photographic light-sensitive material of claim 1, wherein said aryl radical represented by the $R_1$ of Formula [I] is a phenyl radical that is substituted by an alkyl radical.

4. The silver halide photographic light-sensitive material of claim 1, wherein said radical represented by the $R_1$ of Formula [I] is a radical having the following Formula [III]:

Formula [III]

$$R_9—X—R_{10}—$$

wherein $R_9$ is an alkyl radical or a phenyl radical; and $R_{10}$ is an alkylene radical; and X represents a divalent radical.

5. The silver halide photographic light-sensitive material of claim 4, wherein said phenyl radical represented by the $R_9$ of Formula [III] is a phenyl radical substituted by a hydroxyl radical, an alkyl radical or an alkyloxycarbonyl radical.

6. The silver halide photographic light-sensitive material of claim 5, wherein said phenyl radical represented by the $R_9$ of Formula [III] is a phenyl radical having in the second and the fourth positions thereof as substituents branched-chain alkyl radicals.

7. The silver halide photographic light-sensitive material of claim 4, wherein said alkylene radical represented by the $R_{10}$ of Formula [III] is a straight-chain or branched-chain alkylene radical having from 1 to 20 carbon atoms.

8. The silver halide photographic light-sensitive material of claim 7, wherein said alkylene radical represented by the $R_{10}$ of Formula [III] is a straight-chain or branched-chain alkylene radical having from 2 to 14 carbon atoms.

9. The silver halide photographic light-sensitive material of claim 4, wherein said divalent radical represented by the X of Formula [III] is —O—, —S—, —SO— or —$SO_2$—.

10. The silver halide photographic light-sensitive material of claim 1, wherein said radical represented by $R_3$, $R_4$ and $R_5$ of Formula [I] is a hydrogen atom, a halogen atom, an alkyl radical, a cyano radical, hydroxy radical, an alkyloxycarbonyl radical or an alkyl sulfonyl radical.

11. The silver halide photographic light-sensitive material of claim 1, wherein said radical represented by the $Z_1$ of Formula [I] is a hydrogen atom or a halogen atom.

12. The silver halide photographic light-sensitive material of claim 11, wherein said halogen atom represented by the $Z_1$ of Formula [I] is a chlorine atom.

13. The silver halide photographic light-sensitive material of claim 1, wherein said cyan coupler having Formula [I] is contained in said silver halide emulsion layer in a quantity of from 0.1 mole to 1 mole per mole of silver halide.

14. The silver halide photographic light-sensitive material of claim 1, wherein said high-boiling organic solvent having Formula [II] is used in a quantity of from 0.1 part by weight to $1\times10^3$ parts by weight per 100 parts by weight of said cyan coupler having Formula [I].

15. The silver halide photographic light-sensitive material of claim 14, wherein high-boiling organic solvent having Formula [II] is used in a quantity of from 10 parts by weight to 200 parts by weight per 100 parts by weight of said cyan coupler having Formula [I].

16. The silver halide photographic light-sensitive material of claim 1, wherein said light-sensitive material further comprises a magenta dye image-formable component unit comprising at least one green-sensitive silver halide emulsion layer containing at least one magenta dye-forming coupler; and an yellow dye image-formable component unit comprising at least one blue-sensitive silver halide emulsion layer containing at least one yellow dye-forming coupler.

17. The silver halide photographic light-sensitive material of claim 16, wherein said yellow dye-forming coupler is a compound having the following Formula [IV]:

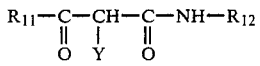

Formula [IV]

wherein $R_{11}$ is an alkyl radical or an aryl radical; $R_{12}$ is an aryl radical; and Y is a hydrogen atom or a radical that can be split off during the course of a color developing reaction.

18. The silver halide photographic light-sensitive material of claim 17, wherein said yellow dye-forming coupler is a compound having the following Formula [V]:

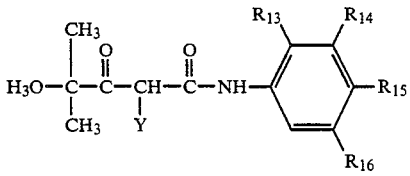

Formula [V]

wherein $R_{13}$ is a halogen atom, an alkoxy radical or an aryloxy radical; $R_{14}$, $R_{15}$ and $R_{16}$ each is a hydrogen atom, a halogen atom, an alkyl radical, an alkenyl radical, an alkoxy radical, an aryl radical, an aryloxy radical, a carbonyl radical, a sulfonyl radical, a carboxyl radical, an alkoxycarbonyl radical, a carbamyl radical, a sulfone radical, a sulfamyl radical, a sulfonamido radical, an acylamide radical, an ureido radical or an amido radical and Y is as defined in Formula [IV].

19. The silver halide photographic light-sensitive material of claim 16, wherein said magenta dye-forming coupler is a compound having the following Formula [VI]:

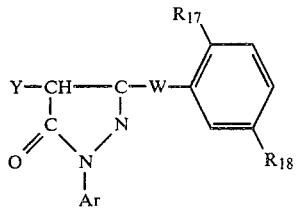

Formula [VI]

wherein Ar is an aryl radical; $R_{17}$ is a hydrogen atom, a halogen atom, an alkyl radical or an alkoxy radical; $R_{18}$ is an alkyl radical, an amido radical, an imido radical, an N-alkylcarbamoyl radical, an N-alkylsulfamoyl radical, an alkoxycarbonyl radical, an acyloxy radical, a sulfonamido radical or an urethane radical; Y is as defined in Formula [IV]; and W is —NH—, —NHCO— (wherein the N atom is bonded with the carbon atom of the pyrazolone nucleus) or —NHCONH—.

20. A silver halide photographic light-sensitive material comprising a support having thereon at least one silver halide emulsion, said silver halide emulsion layer containing at least one cyan coupler having Formula I, said cyan coupler being dispersed into said silver halide emulsion layer by the use of at least one high-boiling solvent having the Formula II:

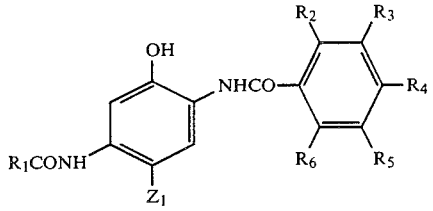

I wherein $R_1$ is a substituted or unsubstituted alkyl or a substituted or unsubstituted aryl; $R_2$, $R_3$, $R_4$, $R_5$ and $R_6$ each is a radical selected from the group consisting of H, halogen, alkyl, alkoxy, aryl, and aryloxy; and $Z_1$ is a hydrogen atom, a halogen atom, or a radical that can be split off by the reaction of said coupler with the oxidized product of an aromatic primary amine-type color developing agent,

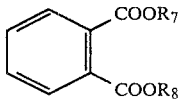

II wherein $R_7$ and $R_8$ each is an alkyl radical, an alkenyl radical or an aryl radical, provided that the sum of the carbon atoms of the radicals represented by $R_7$ and $R_8$ is from 16 to 36.

* * * * *